US012618183B2

(12) United States Patent
Dunn et al.

(10) Patent No.: US 12,618,183 B2
(45) Date of Patent: May 5, 2026

(54) MODIFICATIONS TO WASHER AND DRYER CYCLES FOR A RECREATIONAL VEHICLE COMBINATION LAUNDRY APPLIANCE

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 42 days.

(21) Appl. No.: 18/404,464

(22) Filed: Jan. 4, 2024

(65) Prior Publication Data

US 2025/0223742 A1 Jul. 10, 2025

(51) Int. Cl.

| | |
|---|---|
| ***D06F 33/52*** | (2020.01) |
| ***D06F 34/18*** | (2020.01) |
| *D06F 103/00* | (2020.01) |
| *D06F 105/44* | (2020.01) |

(52) U.S. Cl.

CPC ..... *D06F 33/52* (2020.02); *D06F 34/18* (2020.02); *D06F 2103/00* (2020.02); *D06F 2105/44* (2020.02)

(58) Field of Classification Search

CPC ..... D06F 33/52

See application file for complete search history.

(56) References Cited

U.S. PATENT DOCUMENTS

| | | | |
|---|---|---|---|
| 7,610,643 | B2 | 11/2009 | Hellhake |
| 9,840,804 | B2 | 12/2017 | Schenkl |
| 11,245,544 | B2 | 2/2022 | Lee |
| 2022/0298707 | A1 | 9/2022 | Ekbundit |

FOREIGN PATENT DOCUMENTS

| | | | |
|---|---|---|---|
| CN | 113957673 | A | 1/2022 |

*Primary Examiner* — Jason Y Ko

(74) *Attorney, Agent, or Firm* — Dority & Manning, P.A.

(57) ABSTRACT

A combination washer and dryer laundry appliance for use in a recreational vehicle includes a recreational vehicle mode for operation of laundry profiles. The appliance determines when the vehicle is in motion by monitoring movement of the appliance using on-board sensors or a motion detection feature of an consumer device. When motion is detected, the appliance implements a predetermined responsive action to modify certain standard laundry profiles until the vehicle is stopped. The responsive action may include modification to cycles within the laundry profile during motion of the appliance, or the laundry operation may be suspended.

19 Claims, 5 Drawing Sheets

MODIFICATIONS TO WASHER AND DRYER CYCLES FOR A RECREATIONAL VEHICLE COMBINATION LAUNDRY APPLIANCE

FIELD OF THE INVENTION

The present disclosure relates generally to combination washer and dryer laundry appliances, in particular a combination washer and dryer laundry appliance with modified laundry cycle profiles for a moving recreational vehicle.

BACKGROUND OF THE INVENTION

Recreational vehicles (RVs) typically include a washing machine and dryer, for example a combination washer and dryer laundry appliance. When such laundry appliances are used in a stationary RV, laundry profiles similar to those in a land-based laundry appliance installation may be used. Wash, rinse, spin, and dry cycles may be the same, or substantially the same, as those found in a traditional home setting.

In some cases, it may be desirable to operate a combination washer and dryer in a moving RV. When moving, a combination washer and dryer may be subject to unpredictable loads, accelerations, and imbalances due to, among other things, road conditions and traffic. Under some conditions in a moving RV, certain laundry operations may result in exaggerated displacements, magnified loads, and splashing of wash fluids, potentially damaging the appliance or the vehicle. It may be desirable to modify or suspend certain cycles or portions of cycles to prevent damage.

Consumers may not be aware of the need to suspend or modify laundry operations while the RV is moving or may forget to stop a wash cycle before moving the vehicle. Unintentional operation of a laundry appliance in a moving RV may result in damage to the appliance or vehicle leading to consumer dissatisfaction. Accordingly, it may be desirable to provide a laundry appliance with modified laundry profiles to be automatically implemented when the appliance detects motion.

BRIEF DESCRIPTION OF THE INVENTION

Aspects and advantages of the invention will be set forth in part in the following description, may be apparent from the description, or may be learned through practice of the invention.

In one exemplary aspect, a laundry appliance is presented, the laundry appliance comprises a tub positioned within a cabinet, a basket supported for rotation within the tub, the basket defining a chamber for receipt of laundry articles for washing or drying, a conditioning system, a recirculating air flow system providing fluid communication between the chamber and the conditioning system, wherein the recirculating air flow system, the conditioning system, and the basket define a process air flow path, and a fan operable to move a flow of process air through the process air flow path. A controller is provided for storing a set of standard laundry profiles, the controller configured to receive an input signal indicating that the laundry appliance is in motion, and implement a responsive action based on the input signal.

In another exemplary aspect, a method of operating a laundry appliance is presented. The laundry appliance comprises a tub positioned within a cabinet, a basket rotatably mounted within the tub, the basket defining a chamber for receipt of laundry articles for washing or drying, a conditioning system, a recirculating air flow system for providing fluid communication between the chamber and the conditioning system, and a fan operable to move a flow of process air through a process air flow path. The method comprises receiving an input signal indicating that the laundry appliance is in motion, and implementing a responsive action based on the input signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
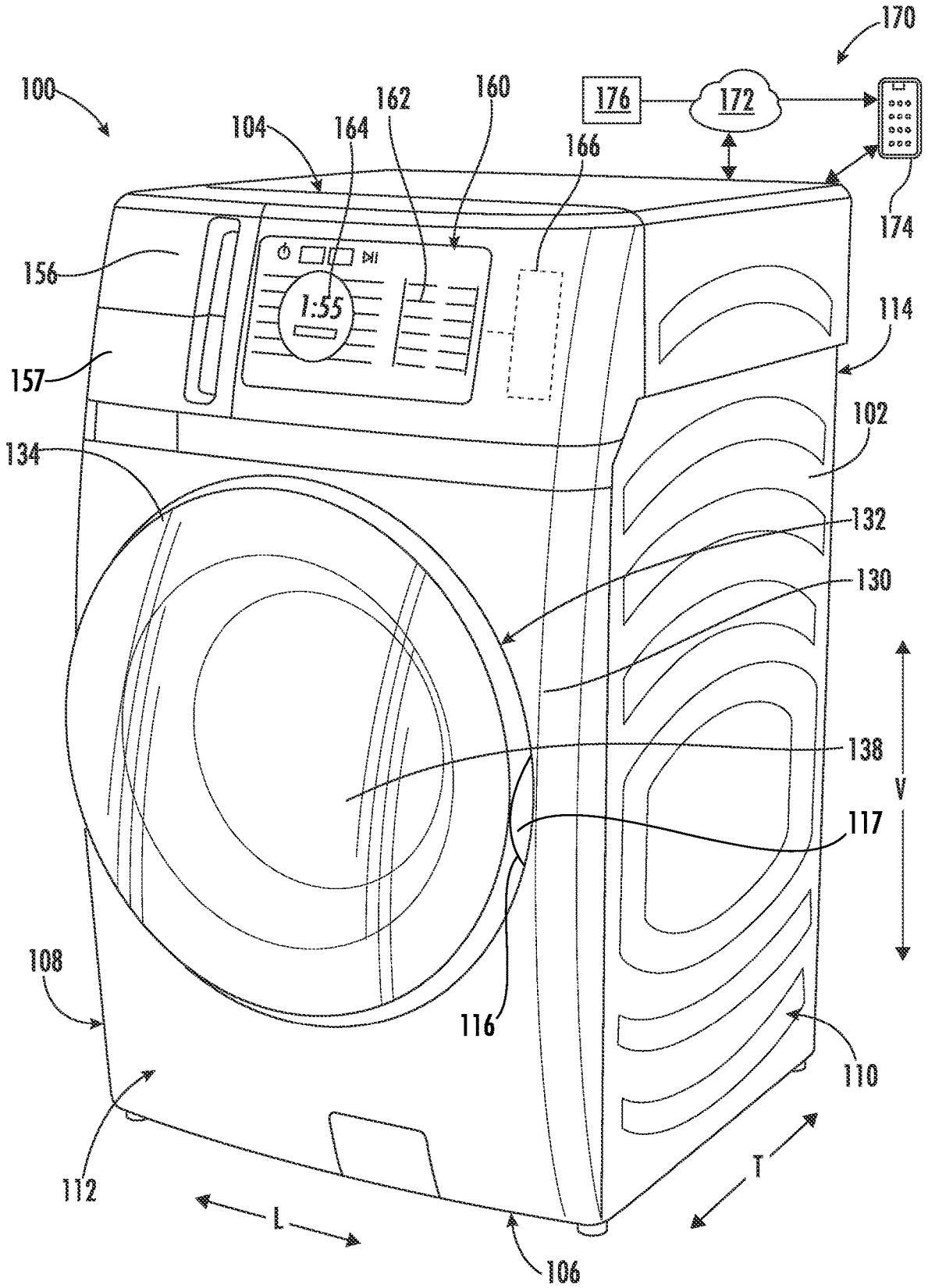
FIG. 1 provides a front perspective view of an exemplary combination washer and dryer laundry appliance in accordance with embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
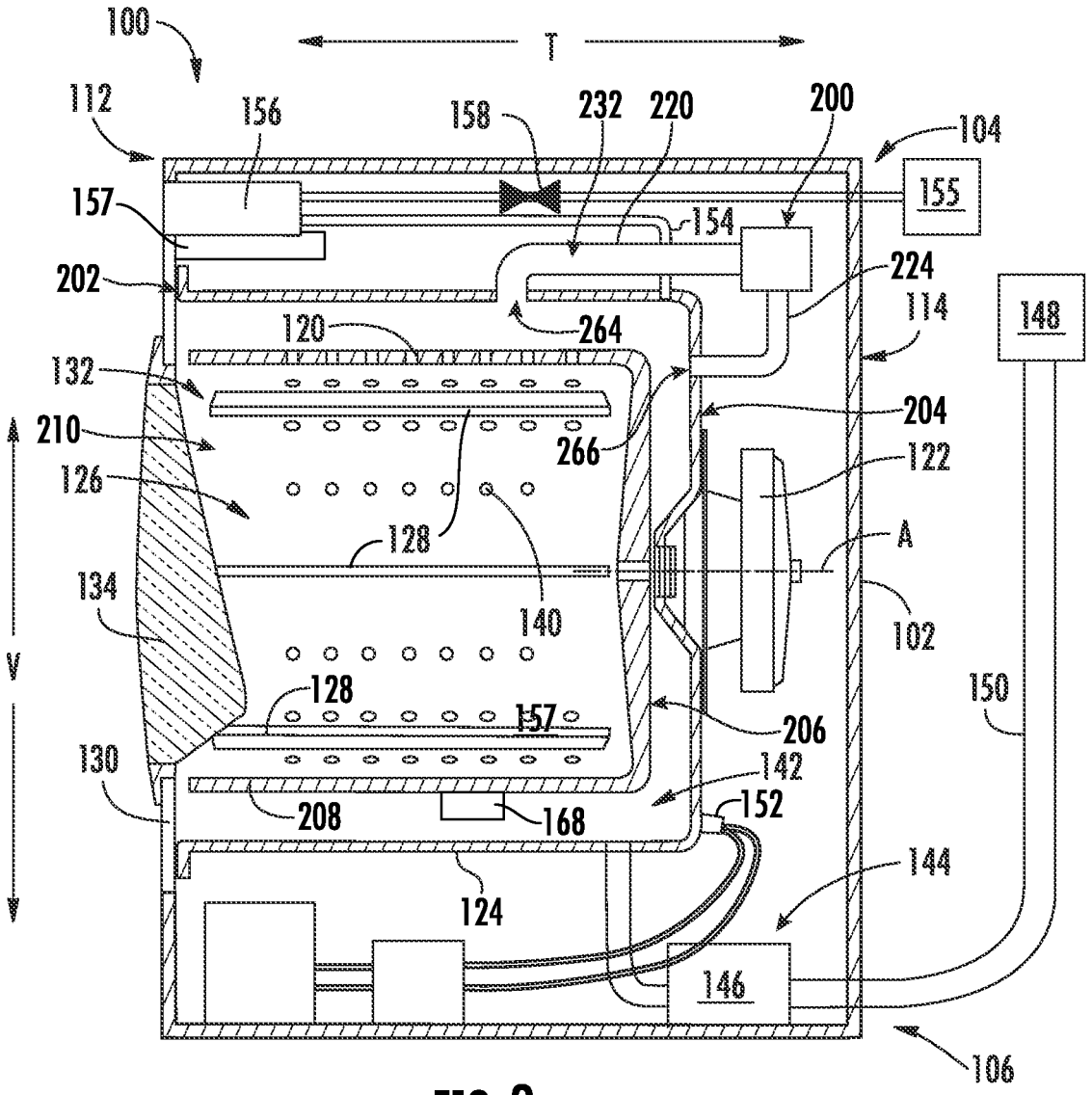
FIG. 2 provides a side cross-sectional view of the exemplary laundry appliance of FIG. 1.
Figure 3:
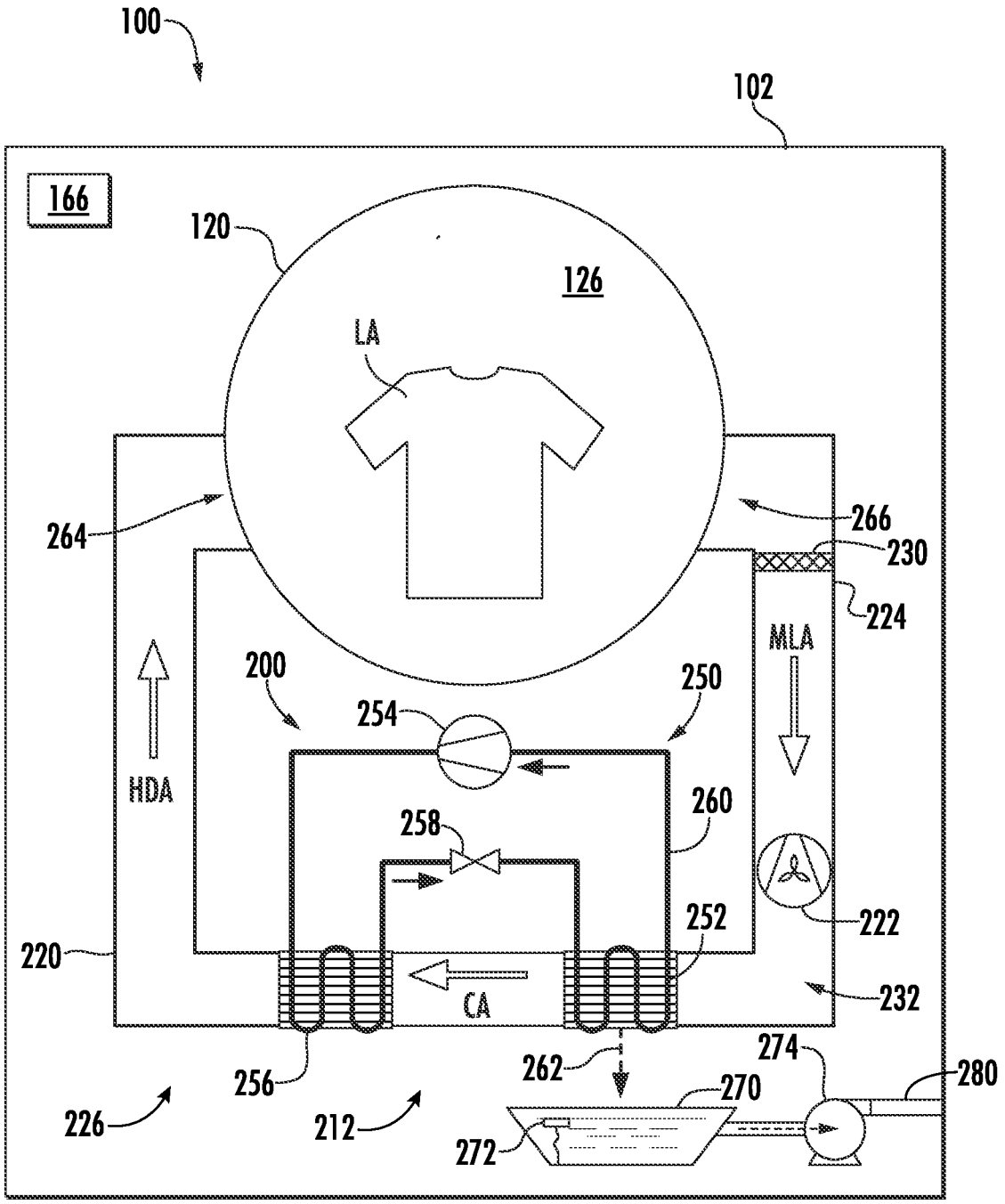
FIG. 3 provides a schematic diagram of an exemplary heat pump dryer appliance and a conditioning system thereof in accordance with exemplary embodiments of the present disclosure.
Figure 4:
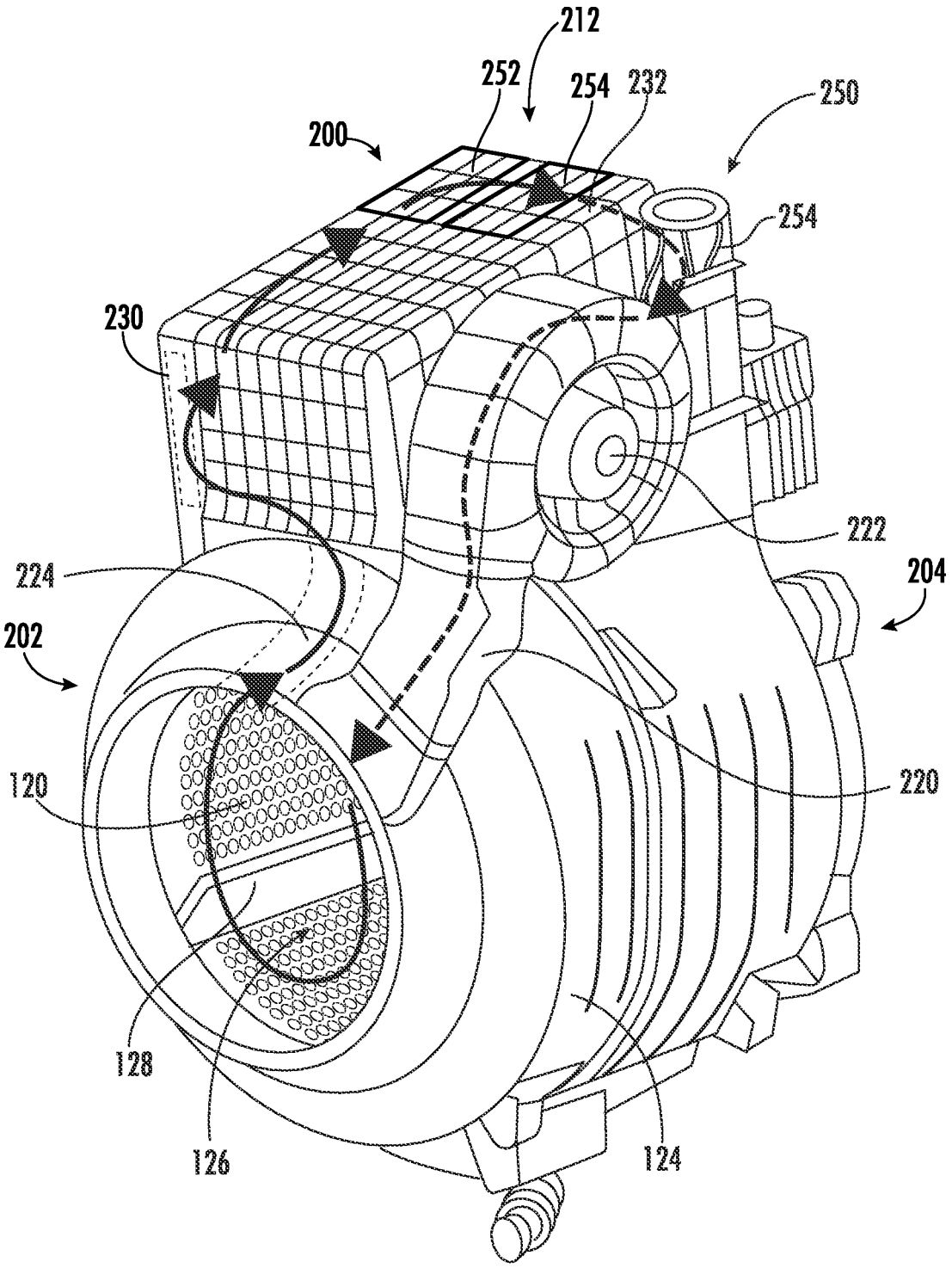
FIG. 4 provides a perspective view of the example laundry appliance of FIG. 1 with a cabinet of the laundry appliance removed to reveal certain components of the dryer appliance.

Referring now to the figures, an exemplary laundry appliance that may be used to implement aspects of the present subject matter will be described. Specifically, FIG. 1 is a perspective view of an exemplary washer and dryer combination appliance 100, for example a horizontal axis washer and condenser dryer, referred to herein for simplicity as laundry appliance 100. FIG. 2 is a side cross-sectional view of the exemplary laundry appliance of FIG. 1. FIG. 3 provides a schematic diagram of an exemplary heat pump dryer appliance and a conditioning system thereof in accordance with exemplary embodiments of the present disclosure. FIG. 4 is a perspective view of laundry appliance 100 with cabinet 102 removed. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIGS. 2 and 3, a laundry basket 120 is rotatably mounted (i.e., supported for rotation) within cabinet 102 such that it is rotatable about axis of rotation A. According to the illustrated embodiment, axis of rotation A is substantially parallel to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle, or a dryer cycle of laundry appliance 100). Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together and/or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIGS. 2 and 3, a plurality of ribs 128 extend from basket 120 into chamber 126. In this manner, for example, ribs 128 may lift articles disposed in laundry basket 120 and then allow such articles to tumble back to a bottom (i.e., a vertically lower portion) of laundry basket 120 as it rotates. Ribs 128 may be mounted to laundry basket 120 such that ribs 128 rotate with laundry basket 120 during operation of laundry appliance 100.

Referring generally to FIGS. 1 through 3, cabinet 102 also includes a front panel 130 which defines an opening 132 that permits user access to laundry basket 120 and tub 124. More specifically, laundry appliance 100 includes a door 134 that is positioned over opening 132 and is pivotally or rotatably mounted to front panel 130. In this manner, door 134 permits selective access to opening 132 by being movable between an open position (not shown) facilitating access to a tub 124 and a closed position (FIG. 1) prohibiting access to tub 124. Laundry appliance 100 may further include a latch assembly or door lock (not shown) for selectively locking door 134 in the closed position. The latch assembly may be desirable, for example, to ensure and verify that door 134 is securely closed during certain operating cycles or events.

A window 138 in door 134 permits viewing of laundry basket 120 when door 134 is in the closed position, e.g., during operation of laundry appliance 100. Door 134 may also include a handle 116, formed as an undercut 117 in the perimeter of the door 134 that a user may grasp when opening door 134. Further, although door 134 is illustrated as mounted to front panel 130, it should be appreciated that door 134 may be mounted to another side of cabinet 102 or any other suitable support according to alternative embodiments.

Referring to FIG. 3, laundry basket 120 also defines a plurality of perforations 140 in order to facilitate fluid communication between an interior of basket 120 and tub 124. A sump 142 is defined by tub 124 at the bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 3) in order to direct fluid (e.g., clean water or wash fluid) into tub 124. Spout 154 may also be in fluid communication with the sump 142. For example, pump assembly 144 may direct wash fluid collected in sump 142 to spout 154 in order to circulate wash fluid in tub 124.

As illustrated in FIGS. 1 and 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155 or a water tank) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 may be coupled to front panel 130. Control panel 160 and input selectors 162 collectively form a user interface input for operator selection of machine cycles and features. For example, in an exemplary embodiment, a display 164 indicates selected features, a countdown timer, and/or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

Generally, during operation of laundry appliance 100, laundry items are loaded into laundry basket 120 through opening 132, and washing operation is initiated through operator manipulation of input selectors 162. Tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the number of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained using, for example, pump assembly 144. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, and/or rinsed, the user can remove the articles from laundry basket 120, e.g., by opening door 134 and reaching into laundry basket 120 through opening 132. Alternately, a drying operation may be initiated. For example, after the articles disposed in laundry basket 120 are cleaned, washed, and/or rinsed, the user may manipulate the input selectors 162 to initiate a drying cycle.

Referring to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through an external network 172. For example, a consumer may use a consumer device 174 to communicate directly with laundry appliance 100. For example, consumer devices 174 may be in direct or indirect communication with laundry appliance 100, e.g., directly through a local area network (LAN), Wi-Fi, Bluetooth, Zigbee, etc. or indirectly through external network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with laundry appliance 100 and/or consumer device 174 through external network 172. In this regard, for example, remote server 176 may be a cloud-based server 176, and is thus located at a distant location, such as in a separate state, country, etc. In general, communication between the remote server 176 and the client devices (e.g., laundry appliance 100, consumer device 174) may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, external network 172 can be any type of communication network. For example, external network 172 can include one or more of a wireless network, a wired network, a personal area network, a local area network, a wide area network, the internet, a cellular network, etc. According to an exemplary embodiment, consumer device 174 may communicate with a remote server 176 over external network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Referring now specifically to FIGS. 2 through 4, features of a conditioning system, condenser system 200, for facilitating a drying process within laundry appliance 100 will be described in more detail. As illustrated, condensing system 200 may be mounted to tub 124 such that it is fluidly coupled to chamber 126. More specifically, as illustrated, tub 124 extends between a front portion 202 and a back portion 204, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet 102 by a suitable bearing or may be fixed.

Laundry basket 120 is generally cylindrical in shape having an outer cylindrical wall 208 and a front flange or wall that defines an opening 210 of laundry basket 120, e.g., at front portion 202 of laundry basket 120. As shown, opening 210 generally coincides with opening 132 of front panel 130 of cabinet 102, e.g., to provide user access to chamber 126 for loading and unloading of articles into and out of chamber 126 of laundry basket 120.

Conditioning system 200 may generally include a return duct 220 that is mounted to tub 124 for circulating process air (i.e., air used in a laundry process, for example the drying cycle) within chamber 126 to facilitate a drying process. For example, according to the illustrated exemplary embodiment, return duct 220 is fluidly coupled to tub 124 proximate a top of tub 124. Return duct 220 receives process air that has been heated and/or dehumidified by a heat exchanger 212 portion of conditioning system 200, the heat exchanger 212 comprising evaporator 252 and condenser 254. The return duct 220 provides the heated process air to laundry basket 120 via one or more holes defined by cylindrical wall 208 of laundry basket 120 (e.g., perforations 140). Accordingly, laundry appliance 100 comprises a recirculating process air flow system. Alternatively, the laundry appliance 100 may be referred to as a ventless system, as no vent is provided to allow an air flow to the outside.

Specifically, moisture laden, heated process air is drawn from laundry basket 120 by an air handler, such as a blower fan 222, which generates a negative air pressure within laundry basket 120 and a positive air pressure within return duct 220. According to the illustrated exemplary embodiment, laundry appliance 100 is a heat pump dryer appliance and thus conditioning system 200 may be a heat pump including a sealed refrigerant circuit, as described in more detail below with reference to FIGS. 3 and 4. Heated process air (with a lower moisture content than was received from laundry basket 120), exits conditioning system 200 and returns to laundry basket 120 by a return duct 220.

As shown, laundry appliance 100 may further include one or more lint filters 230 (FIG. 4) to collect lint during drying operations. The moisture laden heated process air passes through intake duct 224 enclosing screen filter 230, which traps lint particles. More specifically, filter 230 may be placed into an air flow path 232 defined by laundry basket 120, conditioning system 200, intake duct 224, and return duct 220. Filter 230 may be positioned in the process air flow path 232 and may include a screen, mesh, or other material to capture lint in the process air flow 232. The location of lint filter 230 in laundry appliance 100 as shown in FIG. 3 is provided by way of example only, and other locations may be used as well. According to exemplary embodiments, lint filter 230 is readily accessible by a user of the appliance.

FIG. 3 provides a schematic view of laundry appliance 100 and depicts conditioning system 200 in more detail. FIG. 4 provides a perspective view of tub 124 with cabinet 102 removed for clarity and conditioning system 200 positioned on top of tub 124. For this embodiment, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for dehumidifying and heating process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser.

In the below description, and elsewhere in this disclosure, various relative terms are used to describe temperature and moisture qualities of the process air at various locations along the airflow path 232. Generally, process air entering the heat exchanger 212 is moisture laden and cool or cooler than the process air exiting the heat exchanger 212. In particular, process air entering the evaporator 252 generally has more moisture (i.e., is more moisture laden) and is hotter than process air exiting the evaporator 252. Similarly, process air entering the condenser 256 is generally cooler than process air exiting the condenser 256. Accordingly, hot dry process air HDA refers to air leaving the heat exchanger 212 that is hotter and drier than the moisture laden process air MLA entering the heat exchanger 212.

In performing a drying and/or tumbling cycle, one or more laundry articles LA may be placed within the chamber 126 of laundry basket 120. Hot dry process air HDA is supplied to chamber 126 via return duct 220. The hot dry process air HDA enters chamber 126 of laundry basket 120 via a tub inlet 264. The hot dry air HDA provided to chamber 126 causes moisture within laundry articles LA to evaporate. Accordingly, the process air within chamber 126 increases in water content and exits chamber 126 as warm moisture laden process air MLA. The warm moisture laden process air MLA exits chamber 126 through a tub outlet 266 defined by laundry basket 120 and flows into intake duct 224.

After exiting chamber 126 of laundry basket 120, the warm moisture laden process air MLA flows downstream to conditioning system 200. Blower fan 222 moves the warm moisture laden air MLA, as well as the process air more generally, through a process air flow path 232 defined by laundry basket 120, conditioning system 200, intake duct 224, and return duct 220. Thus, generally, blower fan 222 is operable to move process air through or along the process air flow path 232. The duct system includes all ducts that provide fluid communication (e.g., process airflow communication) between tub outlet 266 and conditioning system 200 and between conditioning system 200 and tub inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden process air MLA flows into or across evaporator 252 of the conditioning system 200. As the moisture laden process air MLA passes across evaporator 252, the temperature of the process air is reduced through heat exchange with refrigerant that is vaporized within evaporator 252. This vaporization process absorbs both the sensible and the latent heat from the moisture laden process air MLA, thereby reducing its temperature. As a result, moisture in the process air is condensed on the evaporator 252 and such condensate water 271 may be drained from conditioning system 200, e.g., using a drain line 262 into collection tank 270.

Collection tank 270 is operable to receive condensate water 271 from the process air flowing through conditioning system 200, and more particularly, condensate water 271 from evaporator 252. A fluid level sensor 272 is operable to detect when condensate water within collection tank 270 has reached a predetermined level. Sensor 272 can be any suitable type of sensor, such as a float switch as shown in FIG. 3. Sensor 272 can be communicatively coupled with controller 166, e.g., via a suitable wired or wireless communication link. A drain pump 274 is in fluid communication with collection tank 270. Drain pump 274 is operable to remove a volume of water from collection tank 270 and, for example, discharge the collected condensate water 271 to an external drain or to a gray water collection system. In some embodiments, drain pump 274 can remove a known or predetermined volume of water from collection tank 270. Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Under some circumstances, for example when the controller 166 receives a signal corresponding to movement of the RV, or anticipate movement of the RV, controller 166 may send a command to the pump 274, energizing the pump to drain all of the condensate water 271 from the collection tank 270. In this way, the likelihood of condensate water 271 splashing out of the collection tank 270 while the RV is moving is reduced. Typically, the condensate water 271 is drained to waste line 280 which, in an RV setting, may direct the condensate water 271 to a gray water holding tank.

Process air passing over evaporator 252 becomes cooler than when it exited laundry basket 120 at tub outlet 266. As shown in FIG. 3, cool process air CA (cool relative to hot dry air HDA and moisture laden air MLA) flowing downstream of evaporator 252 is subsequently caused to flow across condenser 256, which condenses refrigerant therein. The refrigerant enters condenser 256 in a gaseous state at a relatively high temperature compared to the cool process air CA from evaporator 252. As a result, heat energy is transferred to the cool process air CA at the condenser 256, thereby elevating the process air temperature and providing hot dry process air HDA for resupply to laundry basket 120 of laundry appliance 100. The hot dry process air HDA passes over and around laundry articles LA within the chamber 126 of the laundry basket 120, such that warm moisture laden process air MLA is generated, as mentioned above.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool process air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden process air MLA received from chamber 126 of laundry basket 120. The process is repeated as process air is circulated along process air flow path 232 while the refrigerant is cycled through sealed system 250, as described above.

Now that the construction of laundry appliance 100 and the configuration of controller 166 according to exemplary embodiments have been presented, an exemplary method 300 of operating a laundry appliance will be described. Although the discussion below refers to the exemplary method 300 of operating combination washer and dryer laundry appliance 100, one skilled in the art will appreciate that the exemplary method 300 is applicable to the operation of a variety of other dryer appliances or laundry appliances. In exemplary embodiments, the various method steps as disclosed herein may be performed by controller 166 or a separate, dedicated controller.

As briefly described above, combination washer and dryer laundry appliances, such as laundry appliance 100, may have features which make them desirable for use in RVs. With some combination washer/dryer appliances, the effectiveness of a full-size washer/dryer pair of appliances may be achieved in the volume of a single appliance. Accordingly, combination washer/dryer appliance may be attractive for use in recreational vehicles (RVs). Significantly, an RV is subject to unpredictable loads, accelerations, and imbalances while moving that may negatively affect the operation of a combination washer and dryer laundry appliance 100. Certain operations, or portions of operations, of a laundry profile may be more susceptible to negative affects and should be avoided or modified if engaged while the RV is moving. Users may forget or neglect to avoid the sensitive portions of a profile while moving which could lead to damage and dissatisfaction. Accordingly aspects of the present disclosure are directed to systems and methods of modifying standard laundry profiles to mitigate any negative affects of operating a combination washer and dryer in a moving RV. In particular, the modifications are enacted with no direct user input. The modifications are made to the standard laundry profile for a typical domestic (i.e., non-mobile) installation. The modifications may be invoked in an RV mode enacted upon installation of the laundry appliance in an RV or the RV mode may be enacted by the user.

Figure 5:
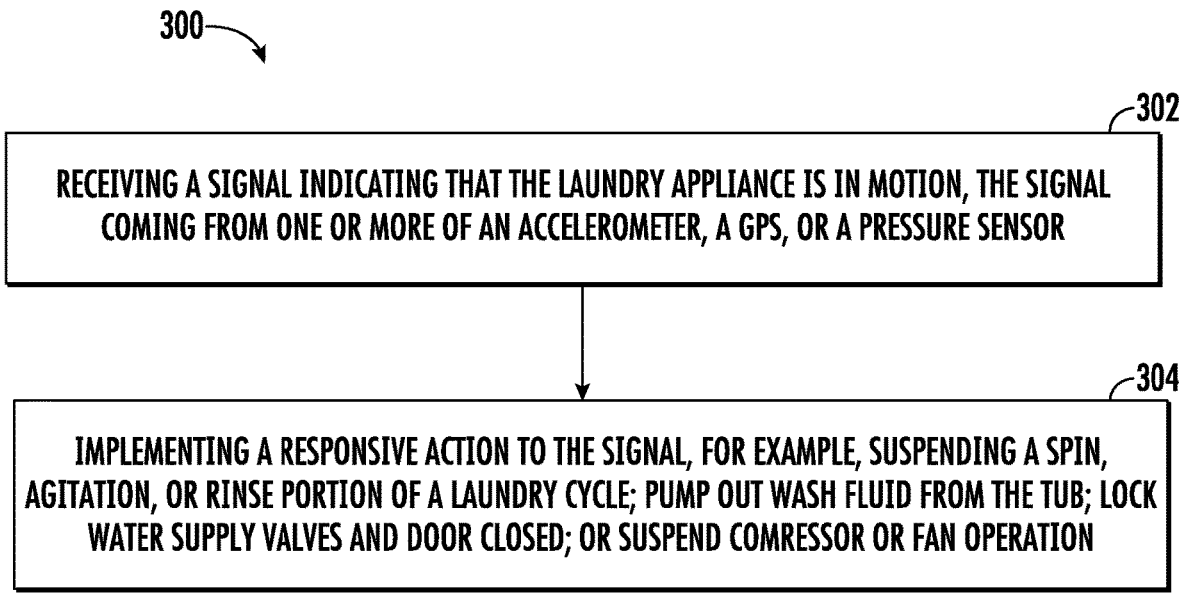
FIG. 5 illustrates a method for operating a laundry appliance in accordance with one embodiment of the present disclosure.

Referring now to FIG. 5, method 300 includes at step 302 for receiving an input signal indicating that the RV is moving, and more specifically that the laundry appliance 100 is moving. For example, the controller 166 of laundry appliance 100 may receive a signal from an accelerometer 168 in the appliance indicating motion of the laundry appliance that is not associated with an operation of the laundry appliance 100. The controller 166 may have operating parameters saved to a memory location, the parameters including anticipated accelerations (e.g., magnitude, frequency, direction, etc.) for a range of operating conditions. If an acceleration, or a number of accelerations, sensed by a motion detection system (i.e., the accelerometers 168) falls outside the anticipated range, that acceleration would be determined to be a motion not associated with an operation of the laundry appliance 100.

In some embodiments, strategic pauses of laundry operations may be added to standard laundry profiles when an RV mode is selected. During the pauses, motion detected by the accelerometer 168 would be due to an external force, and therefore not associated with an operation of the laundry appliance. If the motion detected by the accelerometer exceeds a predetermined criteria (which may include, for example, magnitude, frequency, or direction) the controller 166 may suspend the operation until the motion ceases or user input is received to resume the operation.

As illustrated in the exemplary embodiment of FIG. 2, accelerometer 168 is mounted to the basket 120. In other embodiments, the accelerometer 168 may be mounted to other components of the laundry appliance 100. In some embodiments, more than one accelerometer 169 is mounted to the appliance 100. The accelerometer(s) 168 are operably coupled to the controller 166. The accelerations experienced by multiple accelerometers 168, or the signals associated with the accelerations, may be compared, combined, or otherwise utilized by the controller 166 to determine if the appliance is moving in a manner that may have a negative impact on the laundry appliance 100.

Alternatively or additionally, the laundry appliance 100 may utilize the connected consumer device 174 to determine if laundry appliance 100 is moving. For example, controller 166 may include an algorithm that associates movement or acceleration of the consumer device 174 with movement of the laundry appliance 100. The controller 166 may receive input signals from a global positioning system (GPS) associated with the consumer device 174, for example through external network 172 or directly from the consumer device 174. From the signals, the controller 166 may determine movement of the consumer device 174 and ascribe the same movement to the laundry appliance 100. In addition to, or separately from, the GPS, the consumer device 174 may include an accelerometer which can transmit movement and acceleration information in one or more signals received by the controller 166 through the external network 172 or directly from the device 174.

In an embodiment, the laundry appliance 100 may use pressure sensor 152 to evaluate movement not associated with an operation of the laundry appliance 100. For example, pressure sensor 152 is generally used to determine the depth of wash fluid in the tub 124 and may communicate the depth as a signal proportional to the depth to the controller 166. As the volume of water in the tub increases, the depth, and therefore the pressure, increases as well. Water movement within the tub 124 creates wave-like disturbances in the water. The depth of the water varies as the wave moves about in the tub, causing the pressure sensor to transmit signals corresponding to varying pressures.

Some portions of a wash cycle or laundry operation, such as agitation, may cause the formation of a wave in the tub 124. When the basket 120 is agitating a load of laundry, the controller 166 may disregard the varying pressure signals, as these signals are recognized as associated with an operation of the laundry appliance 100. There are other portions of a wash cycle, such as soak or dwell periods, in which a wave is not associated with an operation of the laundry appliance. If the pressure sensor 152 is sending varying pressure signals to the controller 166 during such periods, the controller may interpret the signal as indicating the laundry appliance 100 is subject to external forces and may be in a moving RV.

In some embodiments, strategic pauses of laundry operations may be added to standard laundry profiles when the appliance is in an RV mode of operation. During the pauses, any motion in the wash fluid or water in the tub as detected by the pressure sensor 152 would be due to an external force, and therefore not associated with an operation of the laundry appliance. If the motion in the wash fluid as detected by the pressure sensor 152 corresponds to movement of the appliance that exceeds a predetermined criteria (which may include, for example, magnitude, frequency, or direction) the controller 166 may suspend the operation until user input is received to resume the operation.

Method 300 also includes step 304 in which a responsive action is implemented in response to step 302 determining the laundry appliance is moving in excess of a predetermined maximum. The responsive action may be implemented to prevent or reduce damage to the appliance or unintended discharge of wash fluid.

In an embodiment, the responsive action may be to suspend the spin portion of the chosen laundry profile until the motion stops or the user overrides the feature. The suspension of the spin portion may be applied to one or more of the standard laundry profiles of the set of standard laundry profiles saved at the controller 166. Laundry loads in the basket 120 may be out of balance at the beginning of a spin cycle. Spinning an out of balance load at a high speed, as in a spin cycle, generates an eccentric rotation of the basket and laundry load. The laundry appliance 100 may include mechanisms to mitigate the eccentricity in a typical domestic installation, but it cannot provide corrective steps for unpredictable movement of the laundry appliance 100 (as in a moving RV) in addition to eccentric rotation of the basket 120 due to an out of balance load.

Some laundry appliances 100 have a load sensing system configured to weigh a load of laundry articles. Such appliance may implement a responsive action in an RV mode comprising reducing the spin speed of the spin cycle of a load of laundry articles in excess of a predetermined weight. The reduced spin speed may be applied to one or more standard laundry profiles of the set of standard laundry profiles saved at the controller 166.

In some embodiments the responsive action may comprise suspending an agitation portion of one or more of the standard laundry profiles of the set of standard laundry profiles saved at the controller. In other embodiments, the responsive action may be to suspend a rinse portion of one or more of the standard laundry profiles.

In general, laundry appliances such as laundry appliance 100 includes one or more water supply valves to regulate the flow of water to, as well as within, the appliance. In embodiments, the RV mode may include a responsive action comprising closing the one or more water supply valves or confirming that the one or more water supply valves are closed.

In some embodiments, the corrective action in the RV mode comprises verifying that the door 134 is closed and locking the door, or confirming the door is closed and locked, against inadvertent opening as the RV is moving.

Many combination washer and dryer laundry appliances include a conditioning system comprising a compressor and a fan. The compressor and the fan may be subject to damage if they are operating while the laundry appliance is moving, as in a moving RV. Accordingly, in some embodiments, the responsive action comprises suspending the operation of at least one of the compressor or the fan.

Many combination washer and dryer laundry appliances include a drain pump fluidly coupled to the tub for removing wash fluid from the tub to an external drain 148, which may be a gray water tank in an RV. To avoid potential leaks and to reduce the moving mass within the tub 124, the responsive action according to some embodiments comprises energizing the drain pump 146 to drain wash fluid from the tub.

The above discussion discloses a set of standard laundry profiles stored at the controller 166 that are subject to modification in an RV mode when the RV is moving. The stored set of standard laundry profiles may be in locations other than the controller 166 in some embodiments. For example, the set of standard laundry profiles may be saved at the external network 172 of external communication system 170. Likewise, in other embodiments, the set of standard laundry profiles may be saved at the consumer device 174 or at the remote server 176. The set of standard laundry profiles may be distributed among one or more of the external network 172, the consumer device 174, or the remote server 176.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A laundry appliance comprising:

a tub positioned within a cabinet;

a basket supported for rotation within the tub, the basket defining a chamber for receipt of laundry articles for washing or drying;

a conditioning system fluidly coupled to the chamber, the conditioning system comprising a return duct;

a recirculating air flow system providing fluid communication between the chamber and the conditioning system, wherein the recirculating air flow system, the conditioning system, and the basket define a process air flow path;

a fan operable to move a flow of process air through the process air flow path; and a controller storing a set of standard laundry profiles, the controller configured to:

receive an input signal indicating that the laundry appliance is in motion; and implement a responsive action based on the input signal, wherein the controller is in operative communication with a pressure sensor mounted in the tub, and wherein receiving an input signal indicating that the laundry appliance is in motion comprises receiving pressure signals from the pressure sensor, the pressure signals not associated with an operation of the laundry appliance.

2. The laundry appliance of claim 1, further comprising an accelerometer operably coupled to the controller, and wherein the input signal is sent by the accelerometer.

3. The laundry appliance of claim 2, wherein the input signal corresponds to a motion of the tub not associated with an operation of the laundry appliance.

4. The laundry appliance of claim 1, wherein the controller is in operative communication with an external device through an external network, the external device including a motion detection system, and wherein the input signal is sent by the external device in response to detected motion of the external device.

5. The laundry appliance of claim 1, wherein implementing the responsive action comprises:

suspending a spin portion of one or more standard laundry profiles of the set of standard laundry profiles.

6. The laundry appliance of claim 1, further comprising:

a load sensing system configured to weigh a load of laundry articles, and wherein implementing the responsive action comprises reducing a spin speed for a spin cycle of laundry articles in excess of a predetermined weight for one or more standard laundry profiles of the set of standard laundry profiles.

7. The laundry appliance of claim 1, wherein implementing the responsive action comprises:

suspending an agitation portion of one or more standard laundry profiles of the set of standard laundry profiles.

8. The laundry appliance of claim 1, wherein implementing the responsive action comprises:

suspending a rinse portion of one or more standard laundry profiles of the set of standard laundry profiles.

9. The laundry appliance of claim 1, further comprising:

one or more water supply valves, and wherein implementing the responsive action comprises closing the one or more water supply valves or confirming that the one or more water supply valves are closed.

10. The laundry appliance of claim 1, further comprising:

a door pivotally mounted to the cabinet for providing selective access to the chamber; and a door lock for selectively locking the door in a closed position, and wherein implementing the responsive action comprises verifying the door is closed and locking the door or confirming the door is closed and locked.

11. The laundry appliance of claim 1, wherein the conditioning system comprises a compressor and a fan, wherein implementing the responsive action comprises suspending operation of at least one of the compressor or the fan.

12. The laundry appliance of claim 1, further comprising a drain pump fluidly coupled to the tub, wherein implementing the responsive action comprises energizing the drain pump to drain a wash fluid from the tub.

13. A method of operating a laundry appliance, the laundry appliance comprising a tub positioned within a cabinet, a basket supported for rotation within the tub, the basket defining a chamber for receipt of laundry articles for washing or drying, a conditioning system fluidly coupled to the chamber, the conditioning system comprising a return duct, a recirculating air flow system providing fluid communication between the chamber and the conditioning system, wherein the recirculating air flow system, the conditioning system, and the basket define a process air flow path, a fan operable to move a flow of process air through the process air flow path, and a controller storing a set of standard laundry profiles, the method comprising:

receiving, by the controller, an input signal indicating that the laundry appliance is in motion; and implementing, by the controller, a responsive action based on the input signal, wherein the controller is in operative communication with a pressure sensor mounted in the tub, and wherein receiving an input signal indicating that the laundry appliance is in motion comprises receiving pressure signals from the pressure sensor, the pressure signals not associated with an operation of the laundry appliance.

14. The method of claim 13, wherein implementing the responsive action comprises: suspending a spin portion of one or more standard laundry profiles of the set of standard laundry profiles.

15. The method of claim 13, wherein implementing the responsive action comprises: reducing a spin speed for a spin cycle of laundry articles in excess of a predetermined weight for one or more standard laundry profiles of the set of standard laundry profiles.

16. The method of claim 13, wherein implementing the responsive action comprises: suspending an agitation portion of one or more standard laundry profiles of the set of standard laundry profiles.

17. The method of claim 13, wherein implementing the responsive action comprises: suspending a rinse portion of one or more standard laundry profiles of the set of standard laundry profiles.

18. The method of claim 13, wherein implementing the responsive action comprises closing one or more water supply valves or confirming that the one or more water supply valve is closed.

19. The method of claim 13, wherein implementing the responsive action comprises: verifying a door is closed and locking the door or confirming the door is closed and locked.

* * * * *